United States Patent [19]

Eversole

[11] Patent Number: 4,750,411

[45] Date of Patent: Jun. 14, 1988

[54] REGISTER BOX AND WYE

[76] Inventor: Larry R. Eversole, 232 Hickory Ridge, Spring, Tex. 77381

[21] Appl. No.: 15,490

[22] Filed: Feb. 5, 1987

Related U.S. Application Data

[63] Continuation of Ser. No. 710,716, Mar. 12, 1985, abandoned.

[51] Int. Cl.[4] ..... F24F 7/04

[52] U.S. Cl. ..... 98/40.05; 98/40.01; 138/162; 285/4; 285/177; 285/192; 285/405; 285/921

[58] Field of Search ..... 98/40.01, 40.05, 114; 138/156, 157, 162, 163; 285/3, 4, 177, 150, 192, DIG. 22

[56] References Cited

U.S. PATENT DOCUMENTS

| | | | |
|---|---|---|---|
| 1,507,269 | 9/1924 | Backmire | 285/177 |
| 2,663,454 | 12/1953 | Olson | 285/4 X |
| 2,703,110 | 3/1955 | Curtis | 285/DIG. 22 X |
| 2,738,990 | 3/1956 | Hill | 285/192 X |
| 2,987,258 | 6/1961 | North | 98/40.01 X |
| 3,128,900 | 9/1964 | Chaboche | 285/DIG. 22 X |
| 3,192,850 | 7/1965 | Martin | 98/38.5 |
| 3,276,182 | 10/1966 | Handley | 138/162 X |
| 3,808,777 | 5/1974 | Neumann et al. | 98/40.05 X |
| 3,944,261 | 3/1976 | Reed et al. | 285/177 X |
| 3,985,158 | 10/1976 | Felter | 98/40.05 X |
| 4,159,674 | 7/1979 | Brumleu, Jr. | 98/40.11 |
| 4,232,421 | 11/1980 | Tucker | 285/177 X |
| 4,249,758 | 2/1981 | Harris | 285/4 X |
| 4,266,470 | 5/1981 | Schroeder et al. | 98/40.11 |
| 4,374,530 | 2/1983 | Walling | 138/162 X |

FOREIGN PATENT DOCUMENTS

| | | | |
|---|---|---|---|
| 2553388 | 6/1977 | Fed. Rep. of Germany | 285/150 |
| 131954 | 8/1978 | German Democratic Rep. | 285/405 |
| 1172404 | 11/1969 | United Kingdom | 285/177 |

*Primary Examiner*—Harold Joyce
*Attorney, Agent, or Firm*—Arthur F. Zobal

[57] ABSTRACT

The box has an end wall and four side walls extending therefrom to an open end. The end wall and each of the side walls has a plurality of different size concentric geometric figures formed by grooves in one side thereof whereby the end wall and each of the side walls may be cut along the grooves to form different size openings for receiving different size conduits for the flow of air therethrough. The open end of the box is adapted to be coupled to an inlet formed through the wall of a house or building for use as a register box. A wye connector adapter plate also is provided for connection to the open end of the box whereby the box may be used as a wye connector. The adapter plate has a plurality of different size concentric geometric figures formed by grooves in one side thereof whereby the adapter plate may be cut along the grooves to form different size openings for receiving different size conduits for the flow of air therethrough. A special collar also is provided for use for connecting air ducts to the box and to the wye connector.

26 Claims, 3 Drawing Sheets

REGISTER BOX AND WYE

This is a continuation of co-pending application Ser. No. 06/710,716 filed 03-12-85 now abandoned.

BACKGROUND OF THE INVENTION

1. Field of the Invention

The invention relates to register boxes and wye connectors for air delivery systems in homes, buildings, etc.

2. Description of the Prior Art

Currently, a large number of different types of register boxes and wye connectors of different sizes and configurations are used in the heating and/or air conditioning systems of homes and/or buildings for connection to different size air ducts and openings. In order to effectively service the home and building construction industry, the distributors or builders must maintain a large inventory of different types of units. A need exists for a universal unit for use as a register box or wye connector and which can be connected to different size conduits.

U.S. Pat. Nos. 3,192,850, 4,159,674, and 4,266,470, disclose different types of manifolds and diffusers for heating and air conditioning systems. These devices are not satisfactory for use as universal register boxes and wye connectors. For example, the devices of U.S. Pat. Nos. 4,159,674 and 4,266,470 are lay-in-devices which are used as diffusers. Air ducts can be connected only to the top end which requires specific routing of the air ducts which increases the cost. The devices of these two patents cannot be used as a wye connector.

The device of U.S. Pat. No. 3,192,850 is a manifold which has two fixed openings 12 and 26. It cannot be used effectively as a universal register box or as a wye connector. Moreover, a large number of the removable plates 20, 22, are required to fit different size air ducts.

SUMMARY OF THE INVENTION

It is an object of the invention to provide a new and useful universal box which may be used as a register box or as a wye connector.

It is a further object of the invention to provide a new and useful collar for use with the box.

The box comprises an end wall and a plurality of side walls extending from said end wall to an open end opposite said end wall defining an interior zone within said walls. Said end wall and at least one of said side walls each have a plurality of different size generally concentric geometric figures formed by grooves in one side thereof whereby said end wall and said one side wall may be cut along said grooves to form different size openings for receiving different size conduits for the flow of air therethrough.

In the embodiment disclosed, each of said side walls has a plurality of different size generally concentric geometric figures formed by grooves in one side thereof whereby each of said side walls may be cut along said grooves to form different size openings for receiving different size conduits for the flow of air therethrough.

In one embodiment, said open end of said box is adapted to be coupled to an inlet formed through the wall of the house or building or the like for the flow of air through said inlet from a conduit coupled to one of said openings formed through said end wall or through one of said side walls.

In another embodiment, an adapter wall is provided for connection to an open end of said box for forming a wye connector. Said adapter wall has a plurality of different size generally concentric geometric figures formed by grooves in one side thereof whereby said adapter wall may be cut along said grooves to form different size openings for receiving different size conduits for the flow of air therethrough.

In the embodiment disclosed, said conduits employed for insertion into said openings each comprises a flexible rectangular shaped member with an offset tab formed at one end and a special groove formed at the other end such that the member may be bent to join its two ends together with the tab inserted into the groove to form a collar. On the outside of the collar, the transition between the two joined ends is smooth. Protuberances are formed on the outside of the collar near its two open ends to facilitate holding the collar in an opening of the box or adapter wall and to facilitate connecting an air duct to the other end of the collar.

DESCRIPTION OF THE PREFERRED EMBODIMENTS

Figure 1:
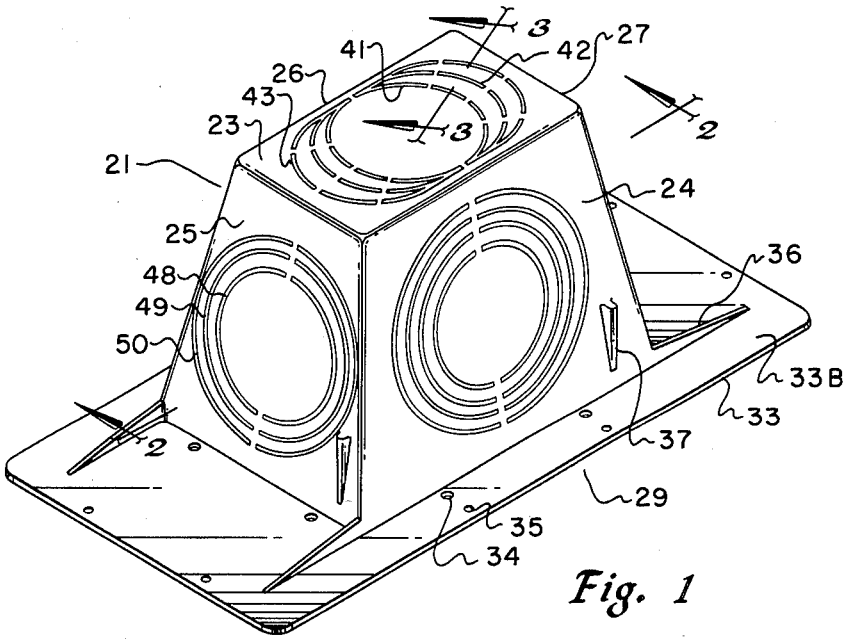
FIG. 1 is a perspective view of the box of the invention.
Figure 2:
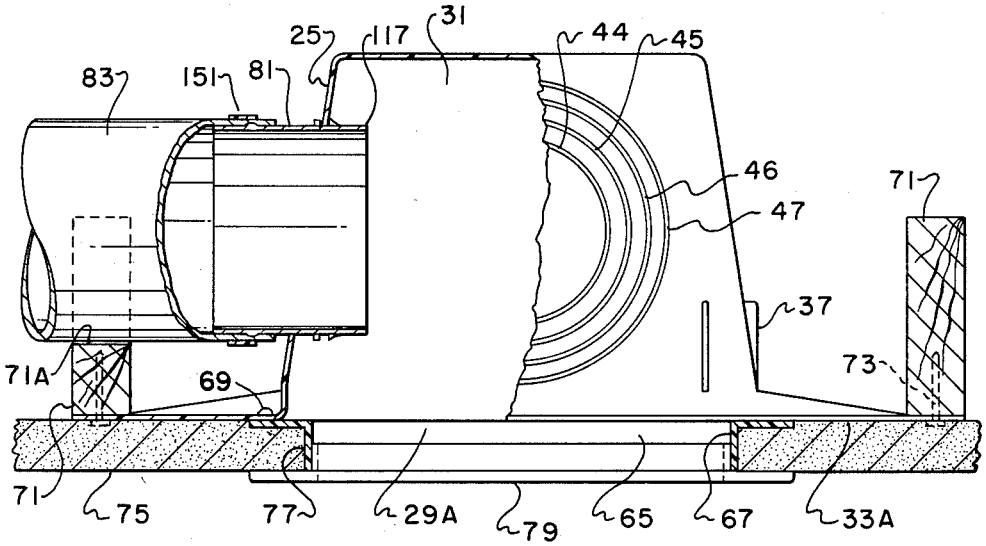
FIG. 2 is a partial cross-sectional view of the box of FIG. 1 taken through the lines 2—2 thereof with an air duct coupled to an opening formed through one of its side walls.
Figure 3:
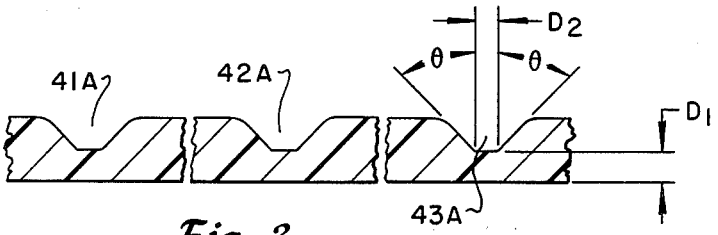
FIG. 3 is a cross-sectional view of FIG. 1 taken along the lines 3—3 thereof.

Referring to FIGS. 1–3 of the drawings, the box of the invention is identified at 21. It is formed of plastic material and comprises a rectangular shaped end wall 23 having four side walls 24–27 extending therefrom to an open end 29. The end 29 comprises a rectangular shaped opening 29A leading to the interior 31 of the box. At the end 29, the side walls 24–27 are joined to a rectangular shaped flange 33 which extends outward on all sides. The flange 33 has holes 34 formed therethrough near the walls 24–27 and smaller holes 35 formed therethrough near its outer edge. Each of the walls 24–27 is in the form of a trapezoid. Members 36 are reinforcing members and members 37 are stacking lugs. The outer side of the end wall 23 has geometric FIGS. 41, 42, and 43, formed by grooves. The grooved FIGS. 41, 42, and 43, are a circle and two elongated curved figures respectively which are concentric with respect to each other. FIG. 3 illustrates the grooves 41A, 42A, and 43A which define the FIGS. 41, 42, and 43. The outer side of wall 24 has concentric circular FIGS. 44, 45, 46, and 47, formed by grooves. Wall 26 is identical to wall 24 and also has concentric circular figures identical to FIGS. 44, 45, 46, and 47, formed by grooves on its outer side. The outer side of wall 25 has concentric circular FIGS. 48, 49, and 50, formed by grooves. Wall 27 is identical to wall 25 and also has concentric circular figures identical to FIGS. 48, 49, and 50, formed by grooves on its outer side. The grooves which define the FIGS. 44–50 are similar to grooves 41A, 42A, and 43A. The walls 23–27 can be easily cut along their grooves 41–50 with a knife to form different size openings through the walls 23–27 for receiving different size conduits for the passage of air therethrough.

Figure 4:
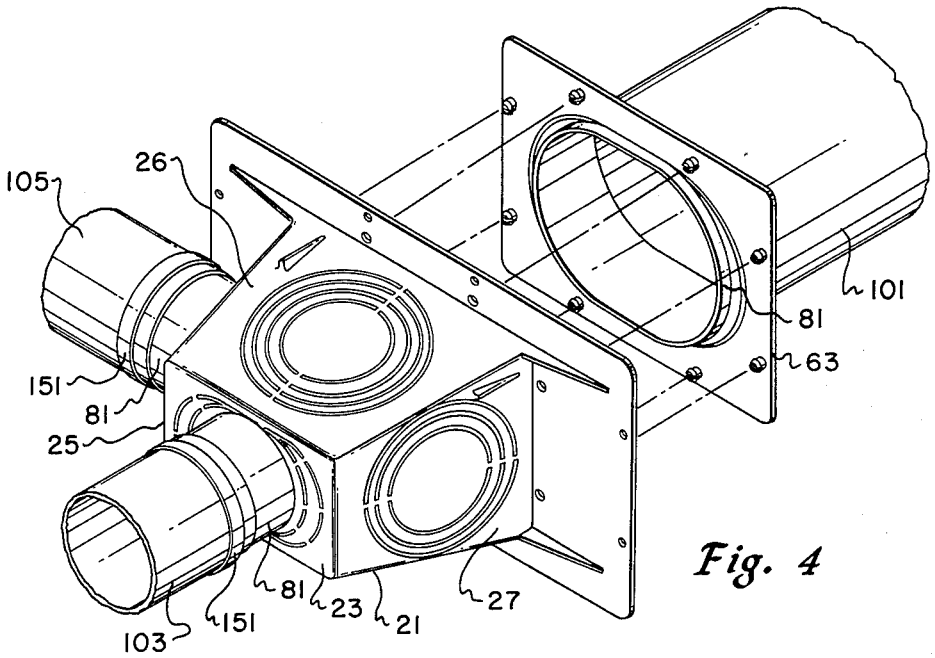
FIG. 4 is a perspective view of the box of FIG. 1 with a wye adapter plate for forming a wye connector.
Figure 5:
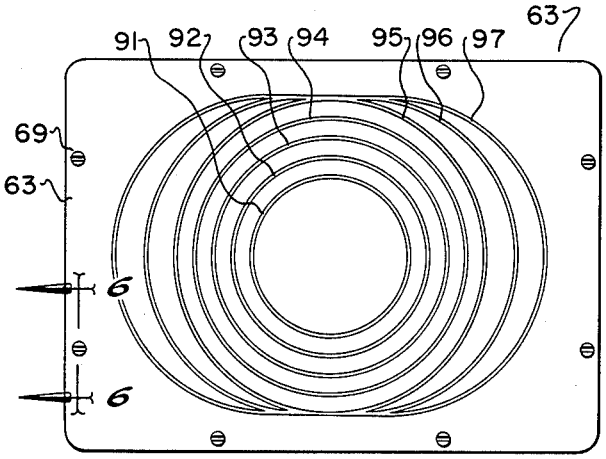
FIG. 5 is a front view of the wye adapter plate of FIG. 4 before it is cut along any of its grooves to form an opening.

Two types of adapter plates are provided for connection to the front side 33A of the flange 33. One type of adapter plate is shown at 61 in FIGS. 2 and 7 and the other type of adapter plate is shown at 63 in FIGS. 4 and 5. The adapter plate 61 of FIGS. 2 and 7 is employed when the box 21 is used as a register box and the adapter plate 63 of FIGS. 4 and 5 is employed to allow the box to be used as a wye connector.

Figure 6:
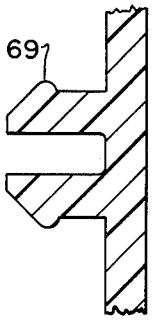
FIG. 6 is an enlarged cross-sectional view of FIGS. 5 and 7 taken along the lines 6—6 thereof.
Figure 7:
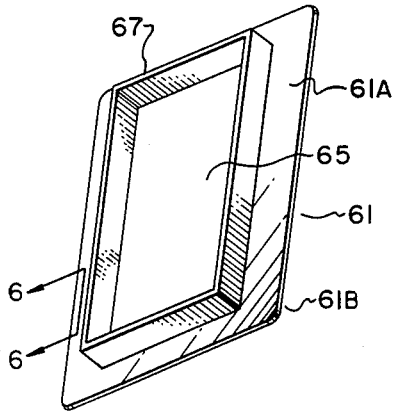
FIG. 7 is another adapter plate for connection to the open end of the box when it is used in the embodiment of FIG. 2.
Figure 8:
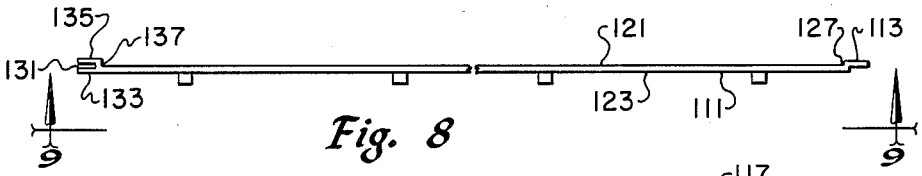
FIG. 8 is an edge view of a flexible rectangular shaped member employed for forming a collar.
Figure 9:
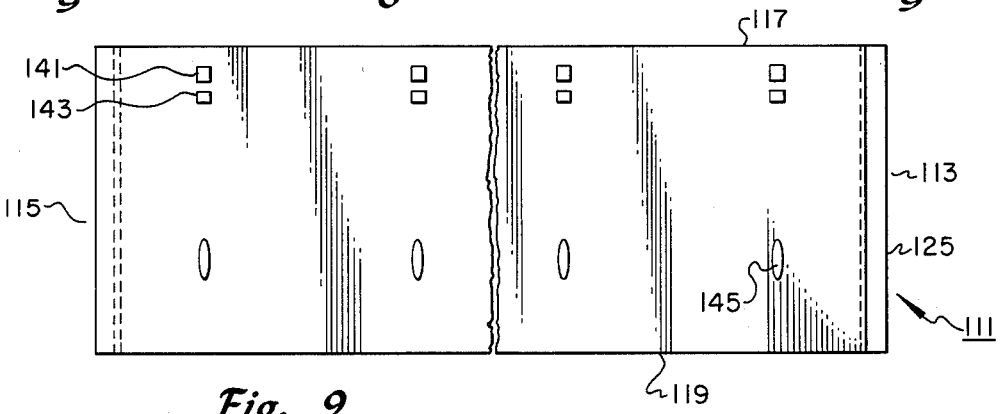
FIG. 9 is a view of the member of FIG. 8 as seen along the lines 9—9 thereof.

Referring to FIGS. 2 and 7, the adapter plate 61 is formed of plastic material and is rectangular in shape. It has a rectangular shaped opening 65 formed therethrough which is smaller than the opening 29A of the box 21. On one side 61A of the plate 61, a small wall 67 extends from the opening 65. On the other side 61B of the plate 61, snap lugs similar to those shown at 69 in FIG. 6 are formed.

During construction of a house or building, the boxes 21 are installed between the joists or beam 71 of the ceiling or walls by placing the back side 33B of the flange 33 against the joists 71 and securing it thereto with nails or screws 73 inserted through the holes 35 and into the joist. In this position, the box 21 will extend between the joists 71. The adapter plate 61 then is secured to the front side 33A of the flange 33 by snap fitting the snap lugs 69 into the holes 34 such that the wall 67 of the plate 61 extends away from the box 21.

When it is desired to couple an air duct to the box 21, an opening of the desired size is formed through either of the walls 23–27 by cutting along the appropriate grooves with a knife. A collar 81 is inserted into the opening and an air duct 83 is coupled to the collar as shown in FIG. 2. By having the grooves formed in all five walls 23–27, the air duct can be coupled to either of the five walls of the box which minimizes the labor and cost of routing the air duct to the box. In FIG. 2, the air duct and collar are shown coupled to the wall 25. An opening 71A is formed through the left joist 71 of FIG. 2 for receiving the air duct 83. Since different size grooves are formed in the walls 23–27, the appropriate size groove can be readily cut to form the desired size of opening for the collar and hence the air duct.

After the air duct is coupled to the box 21, sheetrock 75 having a rectangular shaped opening 77 formed therethrough to receive the wall 67 of the plate 61 then is secured to the joists 71 and against the outer portion of the plate 61 and the flange 33. A register 79 with suitable grills is inserted into the openings 65 of the plate 61 and secured therein with appropriate connecting means.

Referring to FIGS. 4 and 5, the wye adapter plate 63 is formed of plastic material and is rectangular in shape. It has geometric FIGS. 91–97 formed by grooves. The grooved FIGS. 91–97 comprise five circles and two elongated curved figures respectively which are concentric with respect to each other. The grooves are formed in one side of the plate 63. On the same side of the plate snap lugs 69 are formed and extend therefrom. Different size openings can be formed through the plate 63 by cutting along the appropriate grooves 91–97. A wye connector can be formed by cutting along the selected grooves 91–97 to form the desired opening and then snap fitting the plate 63 to the front end 33A of the flange 33 of the box 21 as shown in FIG. 4. The snap lugs will be snap fitted into the holes 34. A collar 81 and an air duct of the desired size then can be coupled to the wye adapter plate 63. Appropriate size openings can also be formed through walls 23–27 and the appropriate size collar and air ducts can be coupled thereto as shown in FIG. 4. In FIG. 4, a larger duct 101 is shown coupled to the wye adapter plate 63 with a collar 81 and smaller air ducts 103 and 105 are coupled to the end wall 23 and to side wall 25 with collars 81 to allow the flow of air from duct 101 to pass to the box 21 and then to different paths defined by air ducts 103 and 105 which is the function of the conventional wye connector. The wye connector preferably will be located in the attic to route the flow of air from a main source to different register boxes coupled to the ceiling for example as shown in FIG. 2.

Figure 10:
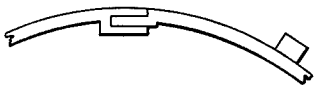
FIG. 10 is a cross-sectional view of the two connecting ends of the rectangular shaped member of FIGS. 8 and 9 joined together to form a collar.

Referring to FIGS. 8–11, the collar 81 of the invention is formed from a thin rectangular shaped member. The member 111 is formed from plastic and is flexible and relatively resilient. The member 111 has two ends 113 and 115 which are coupled together to form the collar and two ends 117 and 119 which form the open ends of the collar when it is formed. Side 121 of the member 111 is defined as the inner side and side 123 is defined as the outer side such that when the member 111 is formed into the collar 81, the inner side 121 is on the inside of the collar and the outer side 123 is on the outside of the collar. The member 111 has a tab 125 which extends along the length of end 113 and which is offset from the thin plate of the member 111 such that it is located on the inner sude 121 and spaced from the outer side 123. The tab 125 is connected to the member 111 by a transverse portion 127 which extends from the inner side 121 of the member 111 to the tab 125. The other end 115 of the member 111 has a groove 131 formed along its length by two spaced apart tabs 133 and 135. Tab 133 is an extension of the member 111 and is in the same plate thereof. Tab 135 is similar to tab 125 and is offset from the thin plane of the member 111 such that it is located on the inner side 121 and is spaced from the outer side. Tab 135 is connected to the member 111 by a transverse portion 137 which extends from the member 111 to the tab 135. In forming the collar, the member 111 is bent such that its side 121 is on the inner side of the collar and its ends 113 and 115 are connected together by inserting the tab 113 into the groove 131. Due to the structure of the tabs 113 and the tabs 133 and 135 forming the groove 131, the transition between the two ends 113 and 115 when they are joined together is smooth as shown in FIG. 10.

Formed on the outer side 123 of the member 111 are a plurality of sets of protuberances 141, 143, and 145. Protuberances 141 and 143 are formed near the end 117 and protuberances 145 are formed near the end 119.

Figure 11:
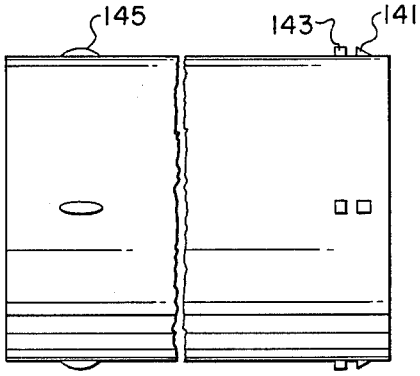
FIG. 11 is a side view of a resulting collar formed.
Figure 12:
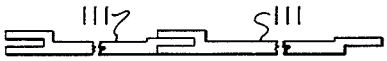
FIG. 12 illustrates two of the rectangular shaped members of FIGS. 8 and 9 coupled together to form a larger collar.

Protuberances 141 are triangular shaped members which flare outward from their forward end to their rearward end as shown in FIG. 11. Formed close to the protuberances 141 are stop members 143. The protuberances 145 are smooth, bump shaped members. The resulting collar 81 formed from the member 111 is inserted into an opening formed through a wall of the box 21 or through the wye adapter plate 63 by inserting the end 117 through the opening until the wall of the box or plate is located between at least one or two of the triangular shaped members 141 and their associated stops 143. Since the member 111 is flexible, it can be readily bent to insert the resulting collar into the opening of the box, or plate. The air duct 83 then is inserted around the other end of the resulting collar and secured in place with a strap 151 which may be a conventional metal strap or a conventional plastic (panduit) strap. The strap 151 will be located forward of the members 145 whereby the members 145 and the strap 151 will act to hold the air duct to the collar 81. Two of the members 111 can be coupled together as shown in FIG. 12 to form a collar of larger diameter.

In one embodiment, the box 21, adapter plates 61 and 63, and the rectangular shaped members 111 forming the collars may be formed of copolymar propylene. The end wall 23 of the box 21 has dimensions of 5.77 inches by 9.84 inches. The height of the box 21 from the outer surface of its end wall 23 to the front side 33A of the flange 33 is 9.5 inches. The side walls 24 and 26 at their bases have dimensions of 12.910 inches. The side walls 25 and 27 at their bases have dimensions of 8.91 inches. The outer dimensions of the flange 33 are 12.41 inches by 24 inches. The radius of the circular flange 41 is 2.5 inches. The radii of the curved portions of FIGS. 42 and 43 are 2 7/16 inches respectively. The radii of circular FIGS. 45, 46, and 47, are 2.5 inches, 3 inches, 3.5 inches, and 4 inches respectively. The radii of the circular FIGS. 48, 49, and 50, are 2.5 inches, 3 inches, and 3.5 inches respectively.

The outer dimensions of the adapter plate 61 are 10 inches by 14 inches. It can have an opening 65 of either 8 inches by 10 inches or 6 inches by 12 inches. The outer dimension of the wye adapter 63 also are 10 inches by 14 inches. The radii of circular FIGS. 91, 92, 93, 94, and 95, are 2 inches, 2.5 inches, 3 inches, 3.5 inches, and 4 inches, respectively. The radii of the curved portions of FIGS. 96 and are 2 inches, respectively. The thickness of the walls and flanges which form the box 21 is about 0.080 of an inch. The thickness of the plates 61 and 63 is about 0.070 of an inch. Referring to FIG. 3, the dimensions of each of the grooves for the box 21 are as follows. D1 is equal to 0.040 of an inch and D2 is equal to 0.020 of an inch. The angles $\theta$ are each equal to 45 degrees. The dimensions of the grooves for the plate 63 are as follows. D1 is equal to 0.035 of an inch and D2 is equal to 0.020 of an inch. The angles $\theta$ are each equal to 30°.

Referring to FIGS. 8 through 11, the distance of the members 141 from the edge 117 is about ¼ of an inch. The length of the members 141 is about 3/16 of an inch and they are spaced about ⅛ of an inch from members 143 which have a length of about ⅛ of an inch. The members 145 have a length of about 1 inch and they are spaced about one inch from the end 119. The height of the members 141, 143, and 145 are about 3/16 of an inch. The member 111 may be formed of copolymer propylene. Its thickness may be 0.070–0.080 of an inch. The dimension of the member 111 along the ends 113 and 115 is about 4 inches whereby the collars are about 4 inches long. The length of the members 111 along the ends 117 and 119 will vary depending upon the diameter of the collar desired. The lengths of the members 111 along the ends 117 and 119 may be sufficient to form collars having diameters of 4 inches, 5 inches, 6 inches, 7 inches, 8 inches, and 9 inches. If collars of greater diameter are desired, two of the members 111 can be coupled together as shown in FIG. 12 to increase the diameter of the collar.

As can be understood, the invention in comprising the box 21, adapter 61, wye adapter 63 and the members 111 have advantages in that they can be readily and cheaply made by injection molding and can provide universal register boxes and wye connectors as well as different size collars with a minimum of parts thereby significantly reducing the inventory of the builder or distributor. The box 21 with adapter plates 61 having two different size openings can replace 12 register boxes now on the market. In addition, the use of the box 21 with the wye adapter 63 takes the place of 25 wyes now on the market. Only six different size collars 111 are needed to fulfill most of the needs of the housing industry. As mentioned above, larger size collars can be formed by coupling two of the members 111 together. A number of the boxes 21 can be nestled and stacked together thereby minimizing storage space and the space required for shipping the boxes. In addition, up to eight of the members 111 can be stacked on top of each other for storage or shipping purposes.

It is to be understood that the boxes 21, plates 61 and 63 and members 111 can have dimensions different from those set forth above.

I claim:

1. A box for connection to an air flow system, comprising:

an end wall, a plurality of side walls extending from said end wall to an open end opposite said end wall defining an interior zone between said walls, said end wall and at least one of said side walls each having a plurality of different size generally concentric geometric figures formed by grooves in one side thereof whereby said end wall and said one side wall may be cut along said grooves to form different size openings for receiving different size conduits for the flow of air therethrough, at least one of said conduits comprises:

a thin flexbile rectangular shaped member having first and second opposite ends, third and fourth opposite ends transverse to said first and second opposite ends, an inner side, and an outer side, said first end of said member comprising a connecting tab formed along the length of said first end which is offset from the thin plate of said member such that said tab is located on said inner side and spaced from said outer side, said second end of said member having a groove formed along the length of said second end by two spaced apart end portions one of which is in the thin plane of said member and the other of which is offset from the thin plane of said member such that said other end portion is located on said inner side and is spaced from said outer side, said rectangular shaped member being adapted to be formed into a conduit by bending said member in a manner to locate said tab in said groove such that said inner side is within said conduit, and said outer side faces in the outward direction, one end of said resulting conduit defined by said third end of said member being adapted to be inserted into an opening formed through the wall of said box, a plurality of a first set of small spaced apart protuberances formed on said outer side of said member near said third end for engaging the inside wall of said box when said one end of said conduit is inserted into an opening formed through the wall of said box for facilitating retention of said one end of said conduit in place in said opening, and a plurality of a second set of small spaced apart protuberances formed on said outer side of said member closer to said fourth end than said first set of protuberances for engaging the inside wall of an air duct to be fitted around said conduit from the end of said conduit opposite said one end.

2. The box of claim 1, wherein:

said open end of said box is adapted to be coupled to an inlet formed through the wall of a house or building or the like for the flow of air through said inlet from at least one conduit coupled to one of the openings formed through said end wall or through said one side wall.

3. The box of claim 1, comprising:

an adapter means for connection to said open end of said box, means for removably connecting said adapter means to said open end of said box, said adapter means having a plurality of different size generally concentric geometric figures formed by grooves in one side thereof whereby said adapter means may be cut along said grooves to form different size openings for receiving different size conduits for the flow of air therethrough.

4. The box of claim 1, wherein:

each of said side walls has a plurality of different size generally concentric geometric figures formed by grooves in one side thereof whereby each of said side walls may be cut along said grooves to form different size openings for receiving different size conduits for the flow of air therethrough.

5. The box of claim 4, wherein:

said open end of said box is adapted to be coupled to an inlet formed through the wall of a house or building or the like for the flow of air through said inlet from at least one conduit coupled to one of the openings formed through said end wall or through one of said side walls.

6. The box of claim 4, comprising:

an adapter means for connection to said open end of said box, means for removably connecting said adapter means to said open end of said box, said adapter means having a plurality of different size generally concentric geometric figures formed by grooves in one side thereof whereby said adapter means may be cut along said grooves to form different size openings for receiving different size conduits for the flow of air therethrough.

7. The box of claim 1, wherein:

said plurality of side walls comprise four side walls, each of said side walls has a plurality of different size generally concentric geometric figures formed by grooves in one side thereof whereby each of said side walls may be cut along said grooves to form different size openings for receiving different size conduits for the flow of air therethrough.

8. The box of claim 7, wherein:

said open end of said box is adapted to be coupled to an inlet formed through the wall of a house or building or the like for the flow of air through said inlet from at least one conduit coupled to one of the openings formed through said end wall or through one of said side walls.

9. The box of claim 7, comprising:

an adapter means for connection to said open end of said box, means for removably connecting said adapter means to said open end of said box, said adapter means having a plurality of different size generally concentric geometric figures formed by grooves in one side thereof whereby said adapter means may be cut along said grooves to form different size openings for receiving different size conduits for the flow of air therethrough.

10. The box of claim 7, wherein:

said end wall and each of said side walls each has a plurality of different size generally concentric curved figures formed by grooves in one side thereof whereby said end wall and each of said side walls may be cut along said grooves to form different size openings for receiving different size conduits for the flow of air therethrough.

11. The box of claim 7, comprising:

an adapter means for connection to said open end of said box, means for removably connecting said adapter means to said open end of said box, said adapter means having a plurality of different size generally concentric curved figures formed by grooves in one side thereof whereby said adapter means may be cut along said grooves to form different size openings for receiving different size conduits for the flow of air therethrough.

12. The box of claim 10, comprising:

an adapter means for connection to said open end of said box, means for removably connecting said adapter means to said open end of said box, said adapter means having a plurality of different size generally concentric curved figures formed by grooves in one side thereof whereby said adapter means may be cut along said grooves to form different size openings for receiving different size conduits for the flow of air therethrough.

13. The conduit of claim 1, wherein:

each of said first set of protuberances has a forward end and a rear end with its forward end being located closer to said third end than said rear end, each of said first set of small protuberances flaring outward from said outer side of said member from said forward end to said rear end.

14. The conduit of claim 1, comprising:

a plurality of a third set of small spaced apart protuberances formed on the outer side of said member between said first and second set of protuberances respectively for engaging the outside wall of said box when said one end of said conduit is inserted into said opening formed through the wall of said box.

15. A box for connection to an air flow system, comprising:

an end wall, a plurality of side walls extending from said end wall to an open end opposite said end wall defining an interior zone between said wall, said end wall and at least one of said side walls each having a plurality of different said generally concentric geometric figures formed by grooves in one side thereof whereby said end wall and said one side wall may be cut along said grooves to form different size openings for receiving different size conduits for the flow of air therethrough, at least one of said conduits comprises:

a thin flexible rectangular shaped member having first and second opposite ends, third and fourth opposite ends transverse to said first and second opposite ends, an inner side, and an outer side, said first end of said member comprising a connecting tab along the length of said first end which is offset from the thin plane of said member such that said tab is located on said inner side and spaced from said outer side, said second end of said member having a groove formed along the length of said second end by two spaced apart end portions one of which is in the thin plane of said member and the other of which is offset from the thin plane of said member such that said other end portion is located on said inner side and is spaced from said outer side, a second thin flexible rectangular shaped member identical to said first thin flexible rectangular shaped member, said first and second rectangular shaped members being coupled together by having said connecting tab of said first rectangular shaped member located in said groove of said second rectangular shaped member such that the inner sides and the outer sides of said first and second rectangular shaped members face in the same directions respectively, said first and second rectangular shaped members being formed into said conduit by having said connecting tab of said second rectangular shaped member inserted into said groove of said first rectangular shaped member with said inner sides of said first and second rectangular shaped members being within said conduit and said outer sides of said first and second rectangular shaped members facing in the outward direction, one end of said resulting conduit defined by said third ends of said first and second rectangular shaped members being adapted to be inserted into an opening formed through said wall, a plurality of a first set of small spaced apart protuberances formed on the outer side of said first and second rectangular shaped members near said third ends for engaging the inside of said wall when said one end of said conduit is inserted into said opening formed through said wall for facilitating retention of said one end of said conduit in place in said opening, and a plurality of a second set of small spaced apart protuberances formed on the outer side of said first and second rectangular shaped members closer to said fourth ends thereof than said first set of protuberances respectively for engaging the inside wall of an air duct to be fitted around said conduit from the end of said conduit opposite said one end.

16. A box formed of plastic material for connection to an air flow system, comprising:

an end wall, a plurality of side walls extending from said end wall to an open end opposite said end wall, said side walls at said open end having edges defining an opening leading to an interior zone between said walls, a flange extending outwardly from said edges of said side walls at said open end such that said flange extends outwardly around said opening, said end wall and at least one of said side walls each having a plurality of different size generally concentric geometric figures formed by grooves in one side thereof whereby said end wall and said one side wall may be cut along said grooves to form different size openings for receiving different size conduits for the flow of air therethrough, said open end of said box being adapted to be coupled to an inlet formed through the structural wall of a house or building or the like with the side of said flange opposite said side walls engaging the structural wall around said inlet, for the flow of air through said inlet from at least one conduit coupled to an opening formed through said end wall or through said one side wall, an adapter means formed of plastic material for connection to said side of said flange of said box, said adapter means having an opening formed therethrough with dimensions such that the area of said opening of said adapter means is less than the area of said opening at said open end of said box, said adapter means having a first side adapted to engage a portion of said side of said flange, connecting means for connecting said first side of said adapter means to said side of said flange with said flange extending outward beyond the outer edges of said adapter means, a relatively short wall means extending generally transversely from the inner edges of said adapter means around said opening of said adapter means on the side of said adapter means opposite said first side, said relatively short wall being adapted to be located in the inlet of the structural wall when said box is coupled to the inlet.

17. The box of claim 16, wherein:

said connecting means comprise snap lugs formed on said first side of said adapter means and snap lug openings formed through said flange of said box for receiving said snap lugs.

18. A box formed of plastic material for connection to an air flow system, comprising:

an end wall, a plurality of side walls extending from said end wall to an open end opposite side end wall, said side walls at said open end having edges defining an opening leading to an interior zone between said walls, a flange extending outwardly from said edges of said side walls at said open end such that said flange extends outwardly around said opening, said end wall and each of said side walls having a plurality of different size generally concentric geometric figures formed by grooves in one side thereof whereby said end wall and said side walls may be cut along said grooves to form different size openings for receiving different size conduits for the flow of air therethrough, said open end of said box being adapted to be coupled to an inlet formed through the structural wall of a house or building or the like with the side of said flange opposite said side walls engaging the structural wall around said inlet, for the flow of air through said inlet from at least one conduit coupled to an opening formed through said end wall or through one of said side walls, an adapter means formed of plastic material for connection to said side of said flange of said box, said adapter means having an opening formed therethrough with dimensions such that the area of said opening of said adapter means is less than the area of said opening at said open end of said box, said adapter means having a first side adapted to engage a portion of said side of said flange, connecting means for connecting said first side of said adapter means to said side of said flange with said flange extending outward beyond the outer edges of said adapter means, a relatively short wall means extending generally transversely from the inner edges of said adapter means around said opening of said adapter means on the side of said adapter means opposite said first side, said relatively short wall being adapted to be located in the inlet of the structural wall when said box is coupled to the inlet.

19. A box formed of plastic material for connection to an air flow system, comprising:

a substantially flat end wall generally rectangular in shape, four substantially flat side walls extending from said end wall to an open end opposite said end wall, said side walls at said open end having edges defining an opening leading to an interior zone between said walls, a flange extending outwardly from said edges of said side walls at said open end such that said flange extends outwardly around said opening, said end wall, said four side walls, and said flange being formed of the same type of plastic material, said end wall being generally parallel to said flange, the distance from said end wall to said flange is greater than the minimum dimensions of the lengths of the edges of said end wall, said end wall and each of said side walls having a plurality of different size generally concentric geometric figures formed by grooves in one side thereof whereby said end wall and said side walls may be cut along said grooves to form different size openings for receiving different size conduits for the flow of air therethrough, said open end of said box being adapted to be coupled to an inlet formed through the structural wall of a house or building or the like with the side of said flange opposite said side walls engaging the structural wall around said inlet, for the flow of air through said inlet from at least one conduit coupled to an opening formed through said end wall or through one of said side walls, an adapter means formed of plastic material for connection to said side of said flange of said box, said adapter means having an opening formed therethrough with dimensions such that the area of said opening of said adapter means is less than the area of said opening at said open end of said box, said adapter means having a first side adapted to engage a portion of said side of said flange, connecting means for connecting said first side of said adapter means to said side of said flange with said flange extending outward beyond the outer edges of said adapter means, a relatively short wall means extending generally transversely from the inner edges of said adapter means around said opening of said adapter means on the side of said adapter means opposite said first side, said relatively short wall being adapted to be located in the inlet of the structural wall when said box is coupled to the inlet.

20. The box of claim 19, wherein:

each of said side walls have two parallel edges of unequal length and two non-parallel edges of equal length, the smallest parallel edge of each of said side walls defining one edge of said end wall.

21. A box formed of plastic material for connection to an airflow system, comprising:

a generally flat end wall generally rectangular in shape, four generally flat side walls extending from said end wall to an open end opposite said end wall, said side walls at said open end having edges defining an opening leading to an interior zone between said walls, a flange extending outwardly from said edges of said side walls at said open end such that said flange extends outwardly around said opening, said end wall and at least one of said side walls each having a plurality of different size generally concentric geometric figures formed by grooves in one said thereof whereby said end wall and said one side wall may be cut along said grooves to form different size openings for receiving different size conduits for the flow of air therethrough, each of said side walls having two generally parallel edges of unequal length and two non-parallel edges of generally equal length, the smallest generally parallel edge of each of said side walls defining one edge of said end wall.

22. The box of claim 21, wherein:

said end wall, said four side walls, and said flange are formed of the same type of plastic material.

23. The box of claim 22, wherein:

the distance from said end wall to said flange is greater than the minimum dimensions of the lengths of the edges of said end wall.

24. The box of claim 22, wherein:

said flange has a side in a plane that extends across said opening with said side walls being located only on one side of said plane.

25. The box of claim 21, wherein:

said open end of said box is adapted to be coupled to an opening formed through the structural wall of a house or building or the like with the side of said flange opposite said end walls engaging the structural wall around the opening of the structural wall, for the flow of air through the opening of the structural wall from at least one conduit coupled to an opening formed through said end wall or through said one side wall, an adapter means formed of plastic material for connection to said side of said flange of said box, said adapter means having an opening formed therethrough with dimensions such that the area of said opening of said adapter means is less than the area of said opening at said open end of said box, said adapter means having a first side adapted to engage a portion of said side of said flange, connecting means for connecting said first side of said adapter means to said side of said flange with said flange extending outward beyond the outer edges of said adapter means, a relatively short wall means extending generally transversely from the inner edges of said adapter means around said opening of said adapter means on the side of said adapter means opposite said first side, said relatively short wall being adapted to be located in the opening of the structural wall when said box is coupled to the opening of the structural wall.

26. The box of claim 21, comprising:

an adapter means formed of plastic material for connection to the side of said flange of said box opposite said side walls, connecting means for connecting said adapter means to said side of said flange of said box, said adapter means having a plurality of different size generally concentric geometric figures formed by grooves in one side thereof whereby said adapter means may be cut along said grooves to form different size openings for receiving different size conduits for the flow of air therethrough.

* * * * *